US008408946B1

(12) United States Patent
Sochor

(10) Patent No.: US 8,408,946 B1
(45) Date of Patent: Apr. 2, 2013

(54) LOW INDUCTANCE CONTACT WITH CONDUCTIVELY COUPLED PIN

(76) Inventor: Jerzy Roman Sochor, Sunnyvale, CA (US)

( * ) Notice: Subject to any disclaimer, the term of this patent is extended or adjusted under 35 U.S.C. 154(b) by 0 days.

(21) Appl. No.: 13/481,815

(22) Filed: May 26, 2012

(51) Int. Cl.
*H01R 13/24* (2006.01)

(52) U.S. Cl. ..... 439/700; 439/824; 324/755.01

(58) Field of Classification Search ..... 439/66, 439/700, 824
See application file for complete search history.

(56) References Cited

U.S. PATENT DOCUMENTS 5,388,997 A * 2/1995 Grange et al. ..... 439/66
6,340,520 B1 * 1/2002 Koike et al. ..... 428/332
6,814,626 B2 * 11/2004 Wen-Yao ..... 439/700
7,019,222 B2 * 3/2006 Vinther ..... 174/260
7,300,288 B1 * 11/2007 Chen et al. ..... 439/66
7,520,754 B1 * 4/2009 Gattuso ..... 439/66
7,559,806 B2 * 7/2009 Lin et al. ..... 439/700
7,666,000 B1 * 2/2010 Hsiao et al. ..... 439/66
7,841,860 B1 * 11/2010 Chen ..... 439/65

* cited by examiner

*Primary Examiner* — Xuong Chung Trans

(57) ABSTRACT

A low inductance contact comprises a coil spring and a conductively coupled pin. The pin has coupling surfaces which enable the coil spring to be attached to the pin in a manner that prevents rotation of the spring's ends. The spring provides an axial pin bias to contact tips, and a torsional bias for conductive coupling between the spring and the pin. The torsional bias is generated by an axial displacement of the spring and by twisting the spring a predetermined angle prior to attachment to the pin. A torsion-induced contact between the pin and the spring enables a conductive path through the pin, while bypassing the coils of the spring. The torsional bias further enables a positive attachment of the spring to the pin. Pins can be fabricated from a drawn profiled stock by stamping or machining. Essential pin coupling features can be prefabricated in a drawn profiled stock.

25 Claims, 12 Drawing Sheets

LOW INDUCTANCE CONTACT WITH CONDUCTIVELY COUPLED PIN

BACKGROUND OF THE INVENTION

1. Technical Field

The present invention relates generally to electrical contacts and probes for interconnecting integrated circuit (IC) devices and electronic components and systems, and specifically, to miniature contacts and probes having a low inductance and a low resistance. Applications include connectors for connecting electronic devices to a next level electronic hardware, test sockets, battery and charging contacts, and other applications requiring low contact inductance and low contact resistance. The connectors can be used in an interposer configuration to separably connect two oppositely disposed components having corresponding input/output (I/O) terminal arrays. Alternatively, the contacts can be permanently attached to a printed circuit board (PCB) or a system motherboard and provide a separable interface for an electronic device. The contacts can be adapted for use with devices having land grid array (LGA) and ball grid (BGA) I/O terminals.

2. Background Art

Sockets and connectors are necessary for separably interconnecting IC devices such as IC packages and electronic modules, to other devices, motherboards, test systems, and alike. A typical application is an electrical connector for connecting an IC device to the next level of electronic hardware or to a test unit. The contacts are positioned and maintained in a required array by an insulating housing which has contact receiving cavities, disposed in a pattern corresponding to the array of I/O terminals in each of the mated devices. The connector is interposed between the terminals of the devices and provides a separable interface to each device. The connector is typically attached by clamping to a PCB or a system motherboard. The clamping preloads each contact against a respective I/O terminal on the PCB. The other end of the contact extends from the housing and is adapted to connect to the corresponding I/O terminal of the mating device.

In electrical contacts, contact force and contact compliance (deflection capability) are important considerations. The contact force must assure a low contact interface resistance without being excessive. The contact compliance must account for planarity tolerances (z-directions variation of I/O terminal location due to tolerances, bowing of the board, etc.,), and to provide an adequate contact engagement even in worst case I/O terminal positioning. However, miniaturization of contacts often leads to contact force and compliance problems since the small contacts tend to be stiff and have a low deflection capability, while the manufacturing tolerances, assembly tolerances, and board planarity, do not scale accordingly and remain substantially the same as for larger contacts.

Many contacts and most test probes rely on a coil spring to provide the contact force and the resilient compliance necessary to assure that the contact force is in the desired range in the worst case tolerance conditions. Coil springs are relatively easy to manufacture in varying sizes, configurations, materials, and degree of compliance. In addition to providing a contact force, a compression spring may also serve as a conductive member. However, a coil spring acts as an electrical inductor at high frequencies and therefore presents electrical performance problems. Furthermore, it is often desirable to make the spring from a music wire or stainless steel which have poor electrical conductivity. Various mechanisms have been employed to mitigate the adverse electrical effects of the spring, as illustrated by the patents cited below.

A typical contact probe consists of a hollow barrel, a spring, and two plungers. The spring and the body portions of the plungers which are guided in the barrel, are retained in the barrel which is rolled or crimped at both ends. In order to reduce the contact resistance and inductance, the conventional contact probes rely on the plungers randomly tilting (i.e., deviating from axial alignment with the barrel) and electrically shorting to the barrel, to enable the current to bypass the spring and flow through the barrel. This conductive coupling significantly lowers the overall contact resistance of the probe and the parasitic electrical effects of the coil spring. The plunger-to-barrel contact depends on the spring bias, fit tolerances of the plunger and the barrel, contact surface topography, and plating uniformity on the inside of the barrel. The diametrical clearance between the plunger and the barrel must be precisely controlled to prevent an excessive tilt. The contact between the plunger and the bore of the barrel is localized along the line of a sliding contact between the edge of the plunger and the bore and an excessive tilt often causes accelerated wear of contacting surfaces. Since the surface of the bore is often irregular and plating of the bore surfaces can be inconsistent, the contact force between the plunger and the bore of the barrel is difficult to control. In severe cases, gauging of surfaces may expose base metal, cause oxidation of surfaces and an accumulation of a nonconductive debris between contact surfaces. This will cause a high contact interface resistance and/or high friction forces which can cause a plunger to seize in the bore.

A contact probe's cycle life is an important consideration in many test applications. If the probe length is short, the probe design, materials, and contact forces have significant impact on the cycle life of the probe and tradeoffs are necessary. The material of choice for miniature springs (e.g., having a mean coil diameter of less than 1.0 mm, and a wire diameter of about 0.1 mm, is music wire. Music wire has a very high tensile strength, and can provide a long mechanical service life at a high operating stress. However, music wire is made from a high carbon steel, is magnetic, and has low electrical conductivity. On the other hand, the preferred material for a spring that is used as a conductive member is beryllium copper, which has a higher conductivity but a lower elastic modulus and a lower strength than music wire.

Contacts have been proposed to address some of the above issues as illustrated by the following patents:

U.S. Pat. No. 7,535,241 (2009) to Sinclair discloses a contact having a barrel, a coil spring, and a plunger. The barrel has a stepped closed end which serves as a stop for the spring and allows the plunger body to conductively short to the barrel. This contact probe relies on a random tilting of the plunger for achieving a conductive contact with the inside surface of the barrel. The bottom of the barrel must be reliably plated, which is difficult, especially when small diameter, large aspect ratio barrels are used.

U.S. Pat. No. 5,990,697 (1999) to Kazama discloses a contact which utilizes a variable pitch coil spring as a primary conductive member. Such spring would be typically made from a higher conductivity alloy such as beryllium copper. The contact has some closely wound coils that become conductively shorted as the deflection progresses. Other coils must remain active so that a solid height is not reached. In order to satisfy the compliance requirement, these springs still require a substantial number of coils which are initially open, and only progressively are being closed (shorted) as the spring is being compressed. Such springs have a non-linear force vs deflection characteristics and can introduce a substantial variation in contact force and inductance due to manufacturing tolerances and non-planarity of mating interfaces. In worst tolerance cases, at a maximum deflection condition the contact force can be excessive, while at a minimum deflection condition an insufficient number of coils may be shorted so that the inductance can be excessively high.

U.S. Pat. No. 7,019,222 (2006) to Vinther discloses a one-piece coil spring contact wherein the coils are at an oblique angle to the direction of compression and are conductively shorted when the spring is compressed. While such contact can provide an excellent electrical performance, it is not scalable to smaller sizes without a significant loss of compliance. In this case, increasing compliance by increasing the number of coils will lead to a wider contact and will necessitate a larger contact-to-contact spacing. Furthermore, the contact is not easily adaptable for use with a variety of contact tips which are often needed to adapt the contacts to a particular I/O terminal configuration, such as a solder ball of a BGA device. In contrast, the conventional coil spring contacts are generally scalable to a smaller footprint by extending the spring length when the spring diameter is reduced. (Although this quickly leads to excessively long contacts with a high self-inductance.)

Other examples of low inductance contacts and probes can be found in U.S. Pat. Nos. 7,556,503 (2009) to Vinther; 7,134,920 (2006) to Ju et al; 6,696,850 (2004) to Sanders; 6,666,690 (2003) to Ishizuka et al; 6,043,666 (2000) to Kazama; 6,033,233 (2000) to Haseyama et al; and 5,641,314 (1997) to Swart et al.

The recent increases in circuit integration and operating frequencies pushed the available coil spring based contacts and probes to their performance limits. Consequently, there is a need for improved miniature contacts and probes having low contact inductance, low contact resistance, and which are suitable for use in sockets and connectors with close contact spacing and high contact count.

SUMMARY

The present invention provides low inductance electrical contacts and connectors for connecting electronic devices and systems having oppositely disposed complementary arrays of I/O terminals. The contact comprises a coil spring and a conductively coupled pin which enables the current to substantially bypass the coils of the spring. The coil spring provides an axial bias for conductive connection of the contact to the respective I/O terminals, and a torsional bias for conductive coupling of the spring to the pin. The torsional bias is further exploited to retentively attach the pin to the spring. In one embodiment, the spring provides contact tips for conductive connection to the respective I/O terminals of both mated devices. In another embodiment, the pin provide a contact tip for mating with a respective I/O terminal of one of the devices.

The pin is adapted to slidably and non-rotatably engage the ends of the spring. The spring is engaged to the pin in a manner that prevents rotation of the spring's ends. When an axial bias is applied to the spring, the spring tends to unwind. Since the ends of the spring are non-rotatably attached to the pin, the spring is unable to unwind and thus generates a torsional bias against the pin. In addition, the spring can be attached to the pin with a predetermined angle of twist to create an initial torsional bias and to retentively attach the pin to the spring. The resultant torsional bias rotationally biases the ends of the spring against the pin and thus provides contact forces for a conductive coupling. The conductive coupling between the ends of the spring and the pin provides a short an direct conductive path through the pin while substantially bypassing the typically inductive and resistive spring. The parasitic electrical effects of the spring are thus substantially mitigated.

Pins can be advantageously fabricated from a drawn profiled wire by stamping or machining. The profiled wire provides spring coupling surfaces which are precisely defined by the drawing process. The coupling surfaces are external and can be easily electroplated. Thus the surface topography and plating can be precisely controlled.

The disclosed contacts can be used in sockets and connectors for applications which require high performance interposer sockets and connectors, where a low inductance, a low resistance, a low wear, or a close contact spacing is required. The contacts can be used as test probes, battery contacts, charging contacts, and as an alternative to more conventional contact technologies in end products such as consumer electronics, aerospace systems, medical devices, and alike.

DRAWINGS

DETAILED DESCRIPTION

Figure 1:
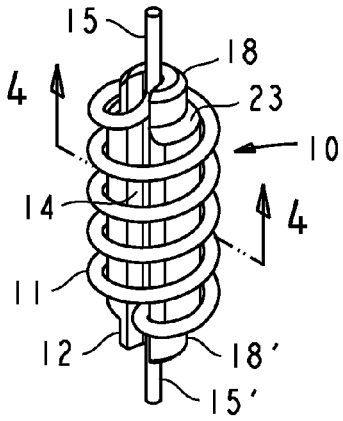
FIG. 1 is a perspective view of a coil spring contact having a torsionally coupled conductive pin.

The disclosed contacts are of the type that are primarily used in an interposer type connector, wherein each contact is compressibly interposed between opposing terminals of a first device and a second device. "First device" and "first array" will generally refer to the device that is being connected whereas "second device" and "second array" will generally refer to the next level device or hardware to which the first device is being disengageably connected, usually represented by a PCB. The "first end" of the contact is disposed to make connection to the first device and is shown on the top side of a contact drawing, whereas the "second end" of the contact is disposed to make connection to the second device and is shown on the bottom side of a contact drawing. The features adjoining the first end the second end of the spring are named accordingly; e.g., "first filar" and "second filar" will be at respective first and second end of a spring. In the cases where the first end and the second end features are substantially similar, those features are denoted by the same reference numerals, except the reference numerals denoting features adjoining the second end are primed when it is required for clarity.

FIGS. 1-5—Coil Spring Contact with Conductive Coupling Pin

Figure 19:
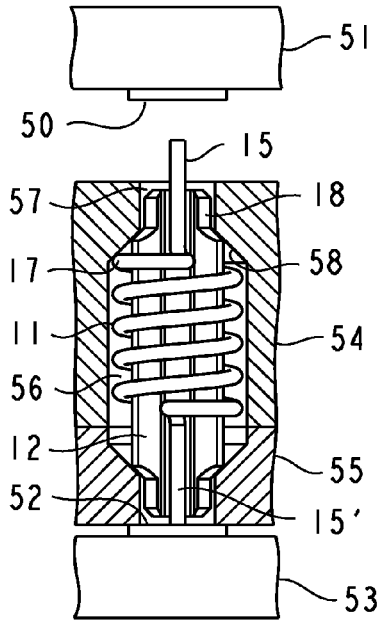
FIG. 19 is a cross-sectional detail of an interposer connector, showing the contact of FIG. 1 assembled in a cavity of an insulative housing, and preloaded against a corresponding terminal of the second device.

FIG. 1 shows a contact 10 which can be used in an interposer connector for connecting a first device to a second device (e.g., as shown in FIG. 19). The contact comprises a coil spring 11 and a pin 12. Both components have a central longitudinal axis and are coaxially disposed. The spring has a first end 13, a second end 13', and a central axis. The pin has a longitudinal coupling channel 14, which enables the spring to be engaged to the pin in a manner that prevents rotation of the spring's ends. When the contact is compressibly interposed between opposing I/O terminals of mating devices, the spring provides the requisite contact force, or axial bias, for conductive connection of the spring ends to the respective I/O terminals of the devices. When the spring is twisted, it further provides a torsional bias for conductive coupling between the ends of the spring and the pin. The conductive coupling between the pin and the ends of the spring establishes a conductive path through the pin, while substantially bypassing the coils of the spring. The contact therefore has a low inductance and a low resistance.

Figure 2:
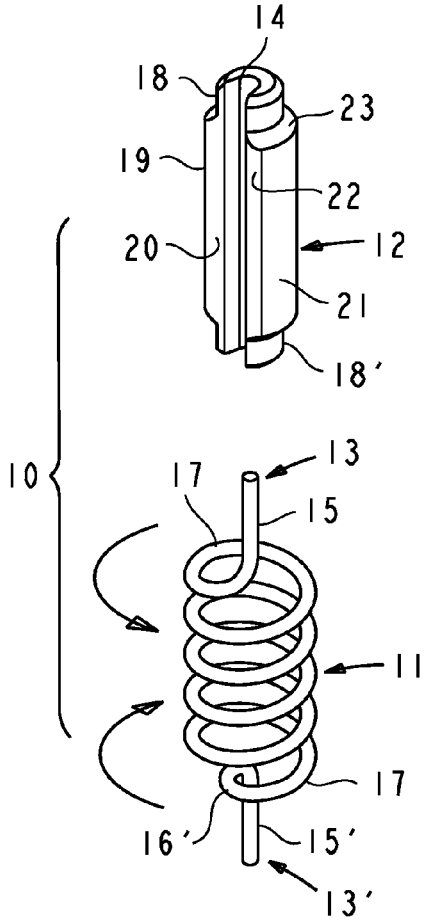
FIG. 2 is an exploded perspective view of the contact of FIG. 1.

The components are shown more clearly on the exploded view of FIG. 2. The first end of the spring comprises a first filar 15 and a first hook 16. Similarly, the second end of the spring comprises a second filar 15' and a second hook 16'. Each filar is substantially aligned with the central axis of the spring and provides a contact tip. Each hook is inwardly formed toward the central axis of the spring and connects the adjoining filar to a respective end coil 17. The pin comprises a first end portion 18, a second end portion 18', and a middle portion 19. The pin further comprises coupling surfaces 20, an outside surface 21, and edge rounds 22. The end portions of the pin have a smaller outside diameter than the middle portion, forming shoulders 23, which provide a retention means for retaining the contact in a cavity of an insulating housing.

Figure 3:
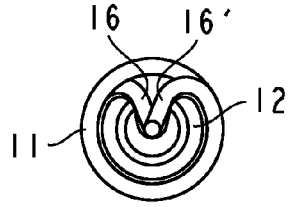
FIG. 3 is a bottom view of the contact of FIG. 1.
Figure 4:
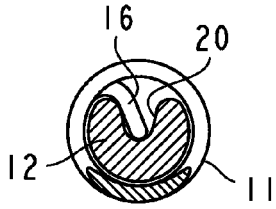
FIG. 4 is a cross-sectional view of the contact of FIG. 1, taken at the mid-point of the contact's length, as indicated by the lines 4-4 of FIG. 1.

FIG. 3 is a bottom view of contact 10. In order to attach the spring to the pin, the hooks must be aligned with the coupling surfaces as seen in FIG. 3. The spring is fabricated with the filars being at a desired angle to each other, so that the spring can be twisted a predetermined angle, as indicated by the twist arrows in FIG. 2, to bring the hooks in contact with the coupling surfaces of the pin. Since the ends of the spring are non-rotatably engaged with the pin, the twist of the spring generates a torsional bias, which conductively couples the pin to the spring. The torsional bias further facilitates a retentive attachment of the spring to the pin. FIG. 4 is a cross-sectional view of contact 10 showing the first end hook of the spring in contact with the respective coupling surface of the pin.

Figure 5:
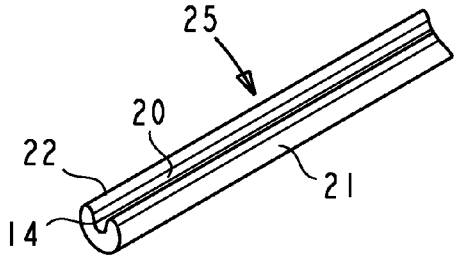
FIG. 5 shows a profiled stock which can be used for fabrication of the pin in the contact of FIG. 1.

FIG. 5 shows a drawn profiled rod or wire stock 25 from which the pin can be fabricated by stamping or machining. The profiled stock has a substantially U-shaped cross-sectional profile, which can be obtained by drawing a continuous wire or a rod through successive dies until the final cross-sectional geometry is attained. This allows the essential features of the pin such as the coupling surfaces, the outside surface, and the edge rounds, to be prefabricated in the drawn stock with a high degree of dimensional accuracy and reproducibility. In particular, the profiled stock provides smooth coupling surfaces with a desired geometry and tight dimensional tolerances. In addition, very small features and small radii can be attained which would be impractical or impossible to achieve by machining. Alternatively, depending on a particular need, the pin can be swedged or machined from a round stock.

FIGS. 6-9—Brief Discussion of Torsional Bias Mechanics

Figure 6:
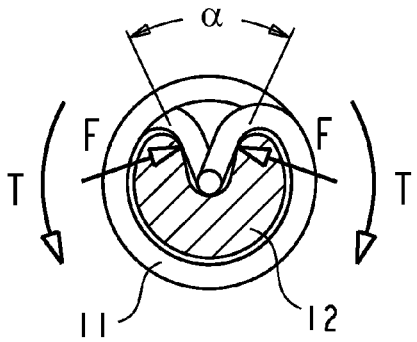
FIGS. 6-9 illustrate the torsional bias mechanics for generation of a conductive coupling between a spring and a pin.

FIG. 6 is a bottom view of contact 10 showing the spring engaged to the pin. The ends of the spring exert torsional bias on the pin as indicated by the torque arrows marked "T". Since the ends of the spring are prevented from rotation, the torsional bias generates contact forces at the coupling surfaces of the pin, indicated by the arrows marked "F". The contact force F=T/a, where "a" is the moment arm for the force F (approximately the distance from the force F to the central axis of the pin). For a given spring, the total torsional bias required to generate a desired coupling force F is approximately:

$$\beta = \frac{3667NFaD}{Ed^4\cos\varphi}(1 + \nu\sin^2\varphi)$$

where:

β—torsional bias in degrees
N—number of active coils
P—axial contact force
D—mean diameter of the coils
d—wire diameter
ϕ—helix pitch angle (slope of the coils)
E—modulus of elasticity
F—contact force at coupling surface
a—moment arm for coupling force F
υ—Poisson's ratio One contribution to the torsional bias is due to the compression of the coil spring. When a coil spring is compressed, the coils attempt to distribute the elastic energy by unwinding. If the ends of the spring are unconstrained, the unwinding will cause the ends of the coil spring to rotate. However, if the ends of the compression spring are prevented from rotation, the spring will be twisted between the constrained ends and thus will exert a torsional bias at the constrained ends. The magnitude of the compression-generated bias can be calculated by considering the compression spring to be a torsion spring with the ends rotated by an angle equivalent to the compression-generated twist. The forces generated will be the same as those required to prevent rotation of the ends due to compression-generated torsional bias. For a given spring compressed by an axial load P, the compression-generated bias β' will be approximately:

$$\beta' = \frac{1833NPD^2}{Ed^4} * \nu\sin\varphi$$

The above formulas are approximate since it is assumed that the spring filars are pivoting about the central axis in a frictionless manner. It is further assumed that the initial spring parameters such as pitch angle ϕ, mean coil diameter D, and the number of active coils N, do not change as the compressive and torsional loads are applied. The formulas do not include any stress correction factors which are customary in spring design practice. It is also assumed that the spring remains elastic under combined axial and torsional bias in all load conditions.

The compression springs used in contacts tend to have a low initial pitch angle ϕ, and will provide a relatively low compression-generated torsional bias. In some cases, the compression-generated bias may be sufficient for conductive coupling between the spring and the pin, especially in combination with other effects such as spring buckling and a random contact tilt in the insulator housing cavity. In most cases, however, an additional torsional bias will be useful to assure a robust conductive coupling between the spring and the pin. The additional torsional bias can be generated by twisting the coil spring a predetermined angle β" before it is attached to the pin, as in contact 10.

While the compression-generated torsional bias is proportional to the spring's compressive displacement and is in the spring unwinding direction, the initial assembly bias is constant (independent of the spring compression) and can be either in the spring winding or spring unwinding direction. The compression-generated bias is also self-cancelling as the spring recoils on unloading of the contact. The recoil of the spring helps the spring contact tips to recover to their original extension. The initial assembly bias, on the other hand, is permanent and provides a constant coupling force.

Figure 7:
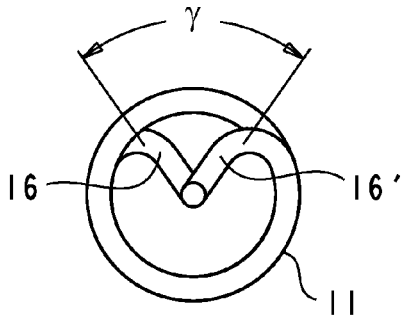
Figure 8:
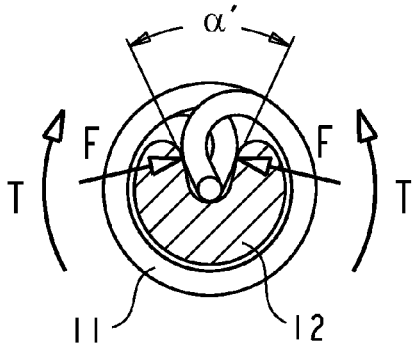
Figure 9:
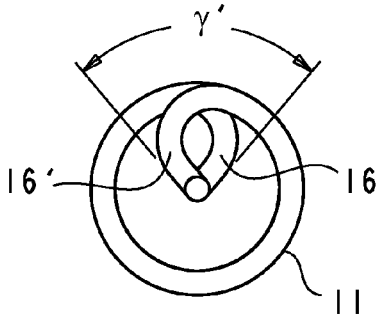

Referring back to the drawings, FIG. 7 shows the bottom view of spring 11 in a free state. The hooks of the spring define a free-state angle γ, which is greater than the angle α after engagement of the hooks with the coupling surfaces of the pin, as seen in FIG. 6. In order to couple the spring to the pin, the spring is twisted in the spring winding direction so that the end hooks of the spring align with the coupling surfaces of the pin. When the spring is assembled with the pin, the twist of the spring is β"=γ−α, in the spring unwinding direction. This urges the springs to unwind and thus provides a torsional bias in the same direction as the compression-generated bias, which is also due to the spring's urge to unwind. However, the assembly twist of the spring can also be in the direction opposite to the direction of spring winding, as illustrated in FIGS. 8-9. In this case, the twist of the spring is β"=γ'−α', in the direction of spring unwinding.

The initial assembly bias β" is cumulative with the compression-generated bias β'. If the initial torsional bias is in the same direction as the compression-generated bias, the assembly twist of the spring needed to meet the total required bias β will be reduced by the magnitude of the compression-generated bias, or β"=β−β'. However, if the assembly bias is in the opposite direction, the required assembly twist of the spring will be increased by the magnitude of the compression-generated bias, or β"=β+β'.

Figure 11:
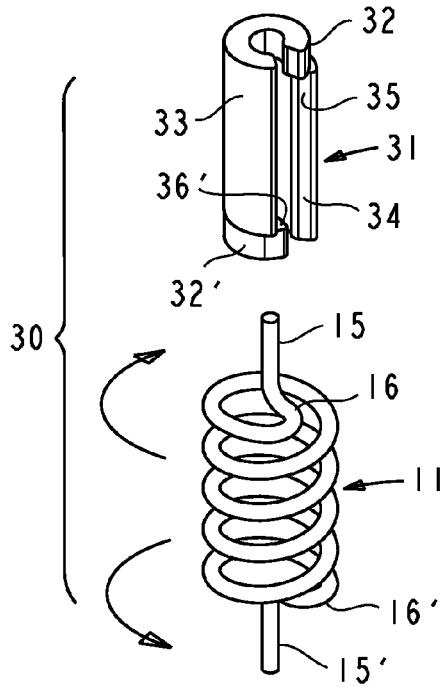
FIG. 11 is an exploded perspective view of the contact of FIG. 10.

The compression springs are usually right-hand wound as reflected in the drawings. The exemplary assembly twist of the spring shown in FIG. 2 is in the spring winding direction. FIG. 11 illustrates assembly twist of the spring in the spring unwinding direction. The magnitude and the direction of the actual assembly twist can be determined based on a particular spring size, material, desired spring parameters, coupling configuration, contact forces, stress considerations, and other requirements. Furthermore, the above principles are also applicable to left-hand wound springs with the direction of the spring winding and the direction of the torsional bias properly accounted for. Since the above formulas are approximate and the torsional bias may be strongly affected by the configuration of spring ends and the manner of spring attachment to the pin, the actual torsional bias is best developed with an experimental input.

In general, the magnitude of the contact force at the coupling surfaces will be a fraction of the axial force P, e.g., ¼ of P. This is necessary in order to assure that the sliding friction due to the torsional coupling is easily overcome by the axial bias of the spring, so that the spring delivers the required contact force to the respective I/O terminals and the contact tips can return to the original extension after the axial force is removed. Lower coupling forces may be adequate if the torsional bias is used only as a precursor to a random conduct. On the other hand, for larger contacts with high axial contact force, the conductive coupling forces between the pin and the spring can be significantly higher.

FIGS. 10-18—Coil Spring Contacts Having Preloaded Spring

The contact embodiments described in this section have a coupling pin which enables retaining the coil spring in a preloaded state. In addition to providing a contact force for a conductive coupling between the spring and the pin, the torsional bias of the spring is exploited to positively attach the spring to the pin. The pin has retention features which sustain the contact preload and prevent disengagement of the spring from the pin. The preload allows the use of a longer spring, with a lower spring rate and a higher compliance, thus reducing contact force variation for a given deflection range. Furthermore, the preload sets the contact tip extension from the pin and minimizes the contact's overall length.

Figure 10:
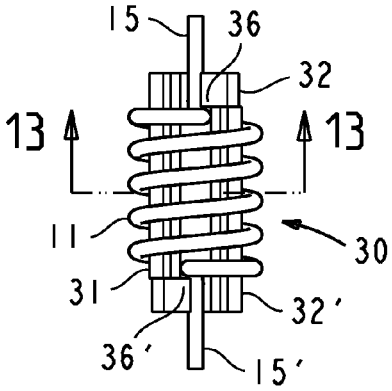
FIG. 10 is a side view of a coil spring contact having a torsionally coupled conductive pin and retained by the pin in a preloaded state.

FIG. 10 is a side view, and FIG. 11 is an exploded view, of a contact 30, comprising spring 11 and pin 31. The contact shares the spring and many pin features with contact 10 described above. The corresponding features are denoted by the same reference numerals. As in contact 10, the pin has coupling surfaces which enable the hooks of the spring to be engaged to the pin in a manner that prevents rotation of the spring's ends. Similarly, a torsional bias is used to enable a conductive coupling of the spring with the pin. The pin has a first end portion 32, a second end portion 32', and a middle portion 33. The pin further has a longitudinal coupling channel 34 having coupling surfaces 35. The end portions of the pin are formed into the channel to provide detents 36 and 36', which are adapted to captivate the respective end hooks of the spring.

Figure 12:
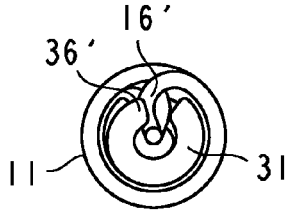
FIG. 12 is a bottom view of the contact of FIG. 10.
Figure 13:
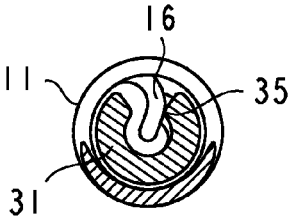
FIG. 13 is a cross-sectional view of the contact of FIG. 10, taken at the mid-point of the contact's length, as indicated by the lines 13-13 of FIG. 10.

In order to attach the spring with a preload, the first end hook of the spring is inserted into the channel until the first end hook stops against the detent at the first end potion of the pin. The spring is subsequently twisted to align the second hook with the coupling channel. After the second hook traverses the passage at the second end portion of the pin, the hook is allowed to rotate back until it is in contact with the respective coupling surface of the pin. FIG. 12 is the end view of contact 30, showing end hook 16' retained by a detent 36'. FIG. 13 is a cross-sectional view of contact 30, taken at the middle portion of the pin, showing a substantially C-shaped cross-sectional profile of the pin and further showing a torsion induced contact between the first end hook of the spring and the respective coupling surface 35 of the pin.

Figure 14:
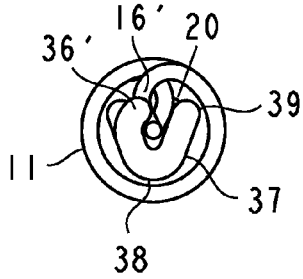
FIG. 14 is a bottom view of a coil spring contact having a coupling pin with a V-shaped cross-sectional profile.
Figure 15:
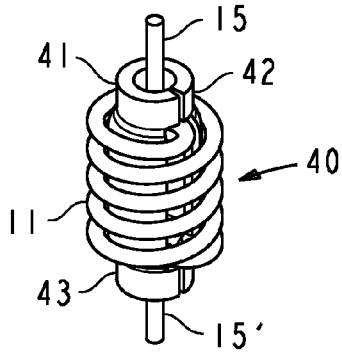
FIG. 15 is a perspective view of a coil spring contact having a torsionally coupled conductive pin and retained by the pin in a preloaded state.

While contact 10 and contact 30 have pins with substantially arcuate cross-sectional profiles, other shapes can be used. FIG. 14 is an end view of a contact variation having a V-shaped cross-sectional profile. Pin 37 has coupling surfaces 20 and detents 36 which are similar to those discussed above. Rounded outside surfaces 38 and 39 locate and guide the coils of the spring. The pin can be advantageously fabricated by stamping.

FIGS. 15-18 show a contact 40, which is a variation of contact 30, wherein an end portion of the pin is crimped to retain the spring on the pin in a preloaded state. Contact 40 comprises spring 11 and pin 41. The pin has a first end portion 42, a second end portion 43, and a middle portion 45. The middle portion has a longitudinal channel 46, which enables the spring to be engaged to the pin in a manner that prevents rotation of the spring's ends. The end portions have a smaller outside diameter than the middle portion, forming retention shoulders 47, which provide a means for retaining the pin in a cavity of an insulating housing.

Figure 16:
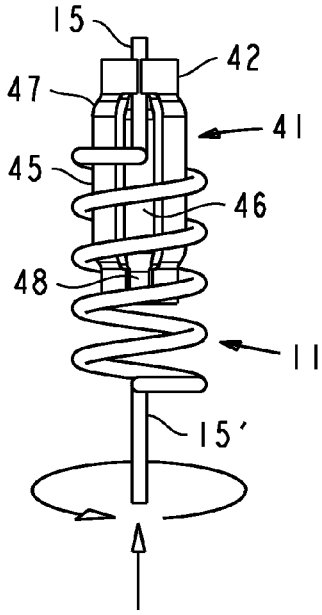
FIG. 16 is a perspective view of the contact of FIG. 15 with the spring partially assembled.
Figure 17:
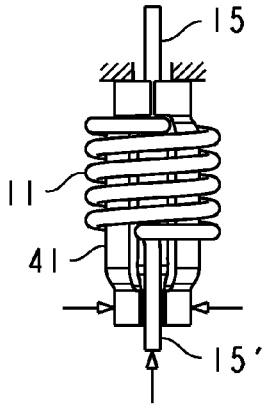
FIG. 17 illustrates crimping of the end portion of the pin to retain the spring.
Figure 18:
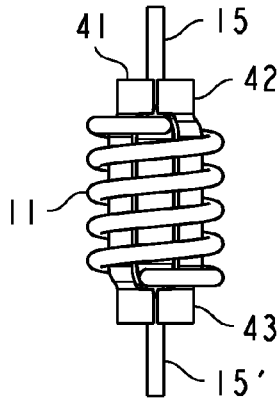
FIG. 18 is a side view of the contact of FIG. 15.

In order to allow engagement of the spring to the pin, at least one of the end portions of the pin must have a passage for the hooks of the spring. In FIG. 16, the first end portion of the pin is formed closed, while the second end portion has a passage 48 which can be traversed by the hooks of the spring. The spring is twisted as shown in FIG. 16 before it is fully engaged with the pin. After both hooks of the spring are within the coupling channel, the second end portion of the pin is crimped as illustrated in FIG. 17, to close passage 48. FIG. 18 shows the pin having both end portions closed and thus positively retaining the spring in a preloaded state.

FIGS. 19-22—Insulator Housing Cavity Details for Retaining Contacts in Sockets and Connectors The disclosed contacts can be utilized in sockets and connectors for connecting electronic devices having complementarily disposed I/O terminal arrays. The devices may include chip packages, bare chips, motherboards, batteries, flexible circuits, leaded devices, LGA devices, and alike. The sockets and connectors are typically used in an interposer configuration which provides separable interfaces for two oppositely disposed components having corresponding terminal arrays. Alternatively, one end of each contacts can be permanently soldered in a plated-through hole of a PCB or a system motherboard while the other end provides a separable connection to an electronic device. Still another option is to plug each contact into a socket which is permanently attached to a terminal of another device or a PCB. In most cases, an insulating housing is required to sustain the contacts in a desired array. FIGS. 19-22 show insulator cavity details for receiving and sustaining various contact embodiments in sockets and connectors. The contacts are typically retentively pre-assembled in the cavities of an insulator housing. The housing usually has a provision for attaching or clamping to a PCB or other device. The cavity features shown in the cross-sectional details can be viewed as round, consistent with drilling and reaming, but other shapes can be obtained by milling or molding.

Figure 20:
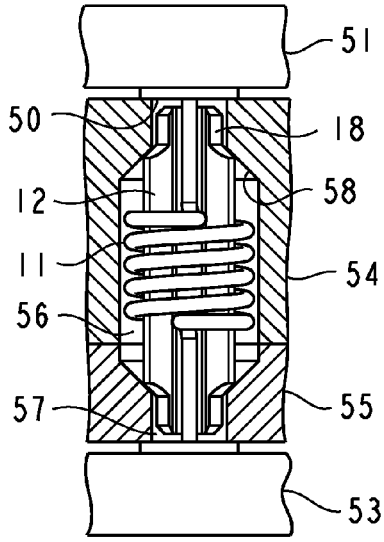
FIG. 20 is a cross-sectional detail of an interposer connector, showing the contact of FIG. 1 assembled in a cavity of an insulative housing and fully compressed between a terminal of the first device and a corresponding terminal of the second device.

FIGS. 19-20 are cross-sectional details of an interposer connector for connecting an LGA I/O terminals 50 of a first device 51, to opposing terminals 52 of a second device 53. The interposer connector utilizes contacts 10, or alike. The contacts are contained in a two-piece housing comprising a first piece 54 and a second piece 55. The two pieces of housing form an inner opening 56 which accommodates the inner portion of the pin and the coils of the spring. Each piece of housing further has an outer opening 57 which locates the respective outer portion 18 of the pin. The outer openings have a smaller diameter than the inner opening, forming retaining surfaces 58. The retaining surfaces cooperate with the shoulders on respective ends of the pin to prevent the pin from escaping the cavity, and to provide a bearing surface when the contact is preloaded against one of those surfaces. The two pieces of housing do not need to be identical. For example, the bottom piece can be thinner or in the form of a retaining plate as shown in FIG. 22.

FIG. 19 shows contact 10 assembled in a cavity of an insulative housing and preloaded against a terminal of the second device. The contact tip of the second filar is axially displaced and exerts a contact force against the second terminal. The first end coil of the spring is preloaded against the retaining surface in the first piece of the insulator housing. The first filar of the spring extends a predetermined distance from the insulator housing. When the first device is forced against the connector as shown in FIG. 20, the contact is fully compressed between the terminal of the first device and a corresponding terminal of the second device.

Figure 21:
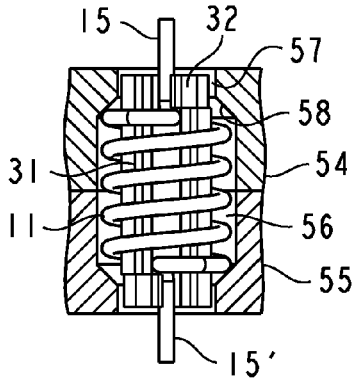
FIG. 21 is a cross-sectional detail of an interposer connector, showing the contact of FIG. 10 assembled in a cavity of an insulative housing.

FIG. 21 is a cross-sectional detail of an interposer connector utilizing contact 30 or alike. The spring and the contact are retentively engaged, with the pin sustaining the spring preload. The preloaded spring is held between the retaining surfaces of the insulator cavity. The end filars extend a predetermined distance from the respective ends of the pin. Since the spring preload and the filar extension are set and sustained by the pin, the spring does not exert pressure against the retaining surfaces of the insulator. This facilitates holding the two pieces of housing together until the insulator housing is clamped to one of the devices. When the spring is fully compressed, pin 31 is contained between respective I/O pads of the mated devices.

Figure 22:
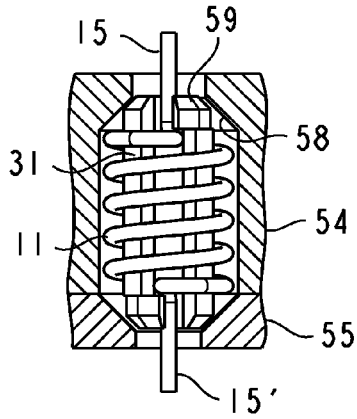
FIG. 22 is a cross-sectional detail of an interposer connector, showing a variation of the contact of FIG. 10 assembled in a cavity of an insulative housing.

FIG. 22 is a cavity detail of an interposer connector utilizing a modified contact 30. Pin 31 further has end surfaces 59, which cooperate with the respective retaining surfaces in the insulator housing cavity to hold the pin captive in the cavity.

FIGS. 23-29—Contact Having Pin with Contact Tip and Continuous Coupling Channel In the contact embodiments disclosed in this section and in the reminder of this specification, the pin is conductively coupled to the spring, and is further adapted to make a direct connection to a device terminal. This combination enables the current to flow through the pin directly to the second end of the spring, while substantially bypassing the first end of the spring and the coils. The pin provides a rigid contact tip which can be adapted for connecting to a variety of device terminals. For example, the pin can have a crown tip for connecting to a solder ball terminal of a BGA device, or a pointed tip for connecting to a pad terminal of an LGA device.

Figure 23:
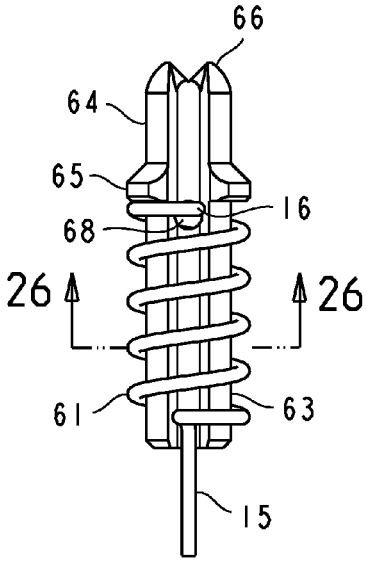
FIG. 23 is a side view of a contact comprising a coil spring and a pin having a crown contact tip adapted for connection to a solder ball terminal of a BGA device.
Figure 24:
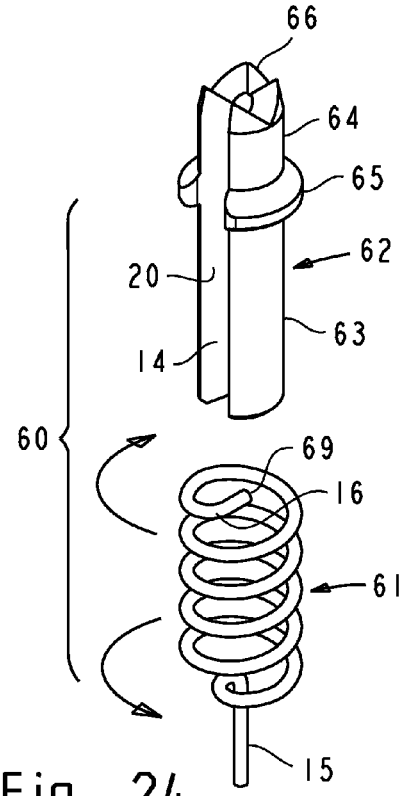
FIG. 24 is an exploded perspective view of the contact of FIG. 23.

FIG. 23 is a side view, and FIG. 24 is an exploded view, of a contact 60, comprising a spring 61 and a pin 62. As in contact 10, the pin has coupling channel 14 and coupling surfaces 20, which enable the spring to be engaged to the pin in a manner that prevents rotation of the spring's ends. Also as in contact 10, a torsional bias is used to enable a conductive coupling of the spring with the pin. The pin has an inner portion 63, an outer portion 64. The pin further has a collar 65, which supports the spring and provides a retention means for retaining the contact in an insulator housing cavity. The outer portion of the pin has a crown tip 66, adapted for connecting to a solder ball of a BGA device.

Figure 25:
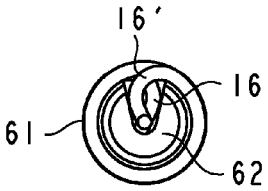
FIG. 25 is a bottom view of the contact of FIG. 23.
Figure 26:
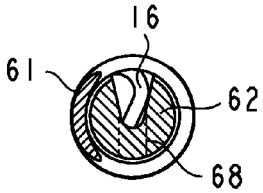
FIG. 26 is a cross-sectional view of the contact of FIG. 23, taken as indicated by the lines 26-26 of FIG. 23.

In order to engage the spring, the first end of the spring is inserted into the channel and the spring is subsequently twisted to align the second hook with the coupling channel. When the spring is fully inserted, the first end coil of the spring is in contact with collar 65, and the second end hook of the spring is engaged to the coupling surface within the coupling channel as shown in FIG. 25. The pin may further have a trap hole 68 to allow the end 69 of first hook 16 to snap into the trap hole, thus positively retaining the spring on the pin. FIG. 26 is a cross-sectional view of contact 60 showing the first hook of the spring engaged with the respective coupling surface of the pin. Trap hole 68 is shown in dotted lines. The cross-sectional profile of the pin is substantially the same as in contact 10, and the pin can therefore be fabricated from profiled stock 25, or alike.

Figure 27:
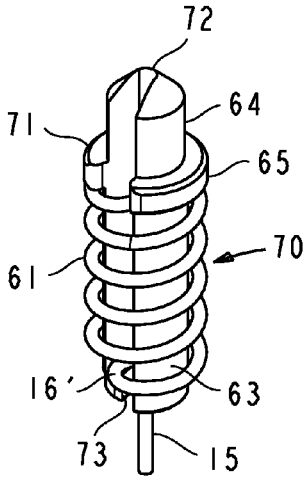
FIG. 27 is a perspective view of a contact comprising a coil spring and a pin having a pointed contact tip adapted for connection to a terminal pad of an LGA device.

FIG. 27 shows contact 70 comprising spring 61 and a pin 71. The pin has a pointed tip 72 adapted for making connection to a terminal pad of an LGA device. The pin further has a detent 73 adapted to captivate the second hook 16' of the spring, thus positively retaining the spring on the pin in a preloaded state. In all other respects, contact 70 can be the same as contact 60.

Figure 28:
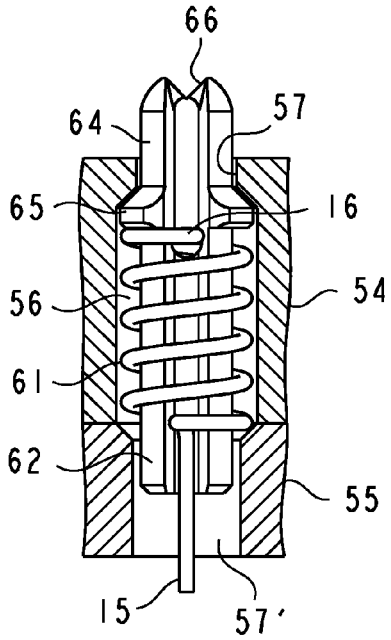
FIG. 28 is a cross-sectional detail of an interposer connector, showing the contact of FIG. 23 assembled in a cavity of an insulative housing.
Figure 29:
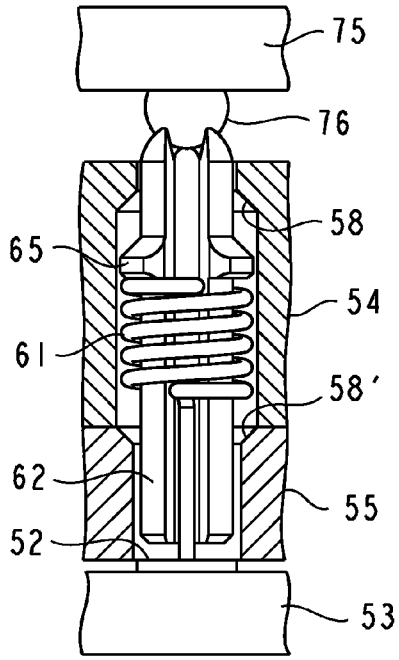
FIG. 29 is a cross-sectional detail of an interposer connector, showing the contact of FIG. 23 assembled in a cavity of an insulative housing and compressed between a solder ball terminal of the first device and a corresponding pad terminal of the second device.

FIGS. 28-29 are partial cross-sectional views of an interposer connector employing contact 60, or alike. The insulator housing comprises first piece 54 and second piece 55. In FIG. 28, the retaining collar of the pin and the end coil of the second end of the spring cooperate with the respective retaining surfaces of the insulator cavity to captivate the contact in the insulator cavity. Outer opening 57 guides the outer portion of the pin, while the outer opening 57' guides the inner portion of the pin. FIG. 29 shows a detail of a connector connecting a first device 75 having BGA terminals 76, to a second device 53 having LGA terminals 52. The contact is compressed between a solder ball terminal of the first device, and a corresponding pad terminal of the second device.

FIGS. 30-34—Contact Having Pin with Coupling Slot

Figure 30:
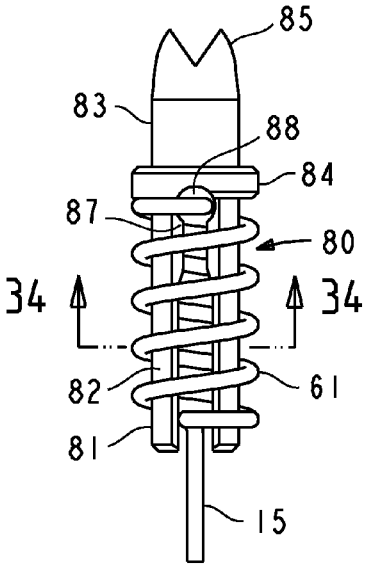
FIG. 30 is a side view of a contact comprising a coil spring and a slotted pin having a crown contact tip adapted for connection to a solder ball terminal of a BGA device.
Figure 31:
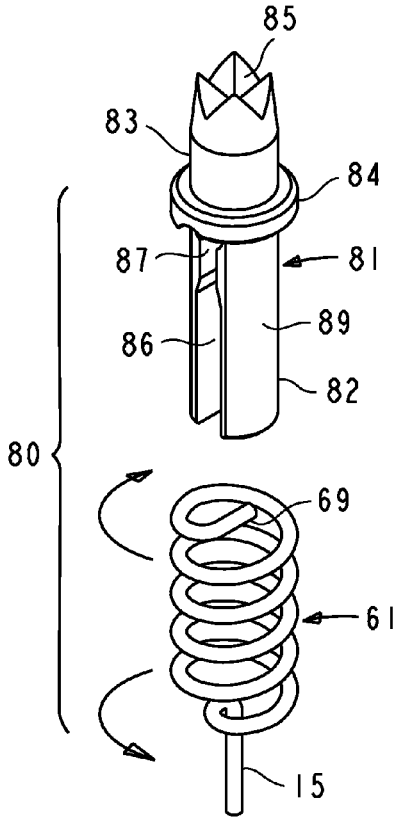
FIG. 31 is an exploded perspective view of the contact of FIG. 30.

FIG. 30 is a side view, and FIG. 31 is an exploded view of a contact 80, which is a variation of contact 60. Contact 80 comprises spring 61 and a pin 81. The pin has an inner portion 82, an outer portion 83. The pin further has a collar 84 which supports the spring and provides a retention means for retaining the contact in an insulator housing cavity. The outer portion of the pin has a crown tip 85, adapted for connecting to a solder ball of a BGA device. The inner portion of the pin has a slot 86, which enables the spring to be engaged to the pin in a manner that prevents rotation of the spring's ends. The slot provides the coupling surfaces which enable a conductive coupling of the spring with the pin when a torsional bias is provided by the spring. The slot further has a detent 87 and a trap hole 88, which enable a positive attachment of the pin to the spring. The outside surfaces 89 locate and guide the spring.

Figure 33:
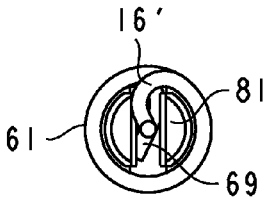
FIG. 33 is a bottom view of the contact of FIG. 30.
Figure 34:
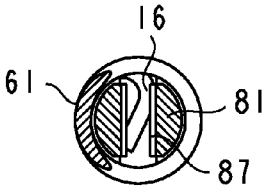
FIG. 34 is a cross-sectional view of the contact of FIG. 30, taken as indicated by the lines 34-34 of FIG. 30.
Figure 32:
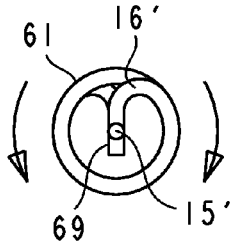
FIG. 32 is a bottom view of the spring with the ends aligned for engagement with the coupling slot of the pin.

In order to engage the spring with the pin, the spring is twisted as indicated on the bottom view of the spring in FIG. 32. When the spring is fully inserted, the first hook of the spring snaps into the end hole, and the second hook of the spring is engaged to the corresponding coupling surface on the side of the slot as shown in FIG. 33. FIG. 34 is a cross-sectional view of contact 80 showing the first end hook of the spring trapped behind the detent and in contact with respective sides of the trap hole.

FIGS. 35-44—Contacts Having U-Shaped Pin Made from Profiled Stock

One of the objects of the present invention is to provide cost effective contacts by using a drawn profiled stock for fabrication of contact pins. Additional cost advantages can be realized when the pins are fabricated from a drawn profiled stock by stamping, which is one of the most cost-efficient fabrication processes and produces precisely dimensioned parts at high production rates and with good reproducibility.

Figure 35:
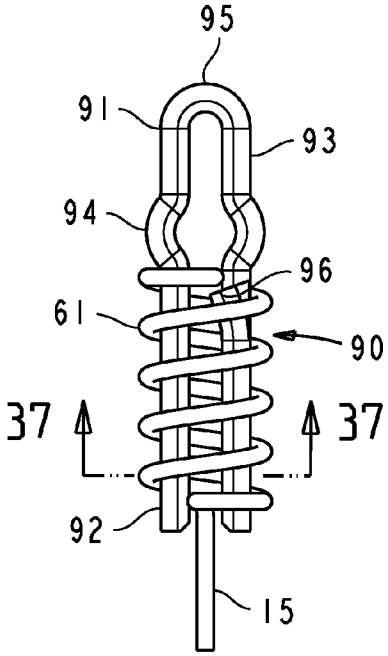
FIG. 35 is a side view of a contact comprising a coil spring contact and a stamped U-shaped pin with a rounded contact tip.
Figure 36:
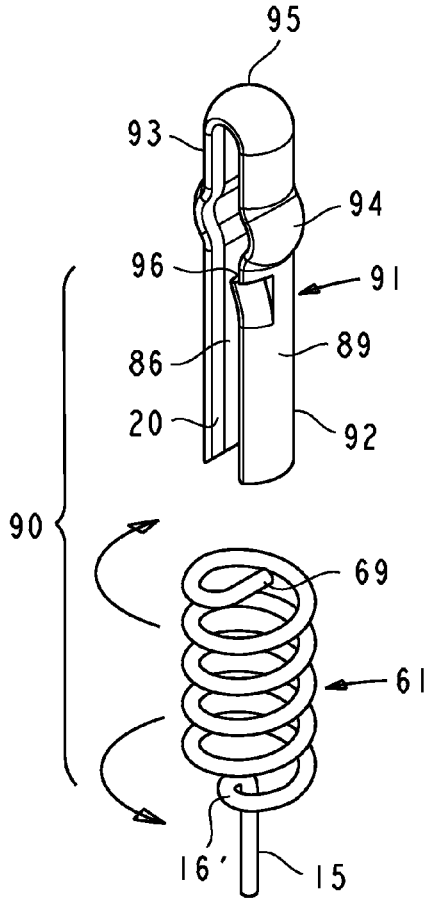
FIG. 36 is an exploded perspective view of the contact of FIG. 35.
Figure 37:
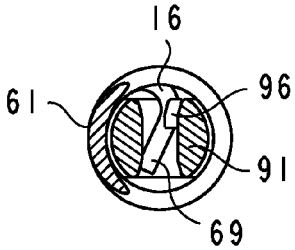
FIG. 37 is a cross-sectional view of the contact of FIG. 35, taken as indicated by the lines 37-37 of FIG. 35.

FIG. 35 is a side view of a contact 90 comprising a U-shaped stamped pin 91 and a spring, such as a previously described spring 61. The components are shown separately in the exploded view of FIG. 36. The pin comprises two tines 92 forming a coupling slot 86. Each tine comprises at least one coupling surface 20 adapted to non-rotatably engage a respective hook of the spring. The coupling surfaces enable a conductive coupling of the spring with the pin when a torsional bias is provided by the spring. Each tine further comprises an outside surface 89 adapted to locate and guide the spring. The pin further comprises an outer portion 93, and formed shoulders 94. The bottom of the "U" forms a rounded contact tip 95. The shoulders provide bearing surfaces for supporting the first end of the spring and a retention means for retaining the contact in an insulator housing cavity. The slot further has at least on detent 96, which captivates first hook 16 of the spring, thus positively attaching the pin to the spring. FIG. 37 is a cross-sectional view of contact 90 showing the first end hook of the spring trapped behind the detent.

Figure 38:
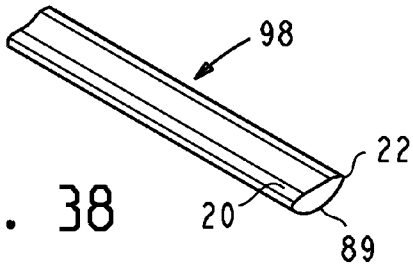
FIG. 38 shows a profiled stock which can be used for fabrication of the U-shaped pin of FIG. 35.

FIG. 38 shows a drawn profiled stock 98, from which U-shaped pin can be formed. The coupling surfaces, the edge rounds, and the outside surfaces are present in the profiled stock. The shoulders and the detents can be formed in a blank stage, before folding the profiled stock into the U-shaped configuration. Using such profiled stock can be advantageous for economically producing short contacts with rounded contact tips.

Figure 39:
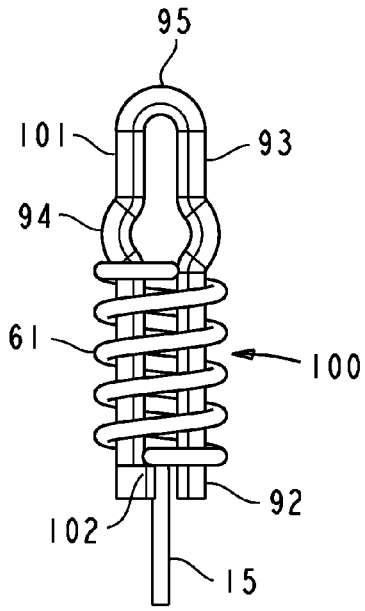
FIG. 39 is a side view of a contact comprising a coil spring and a U-shaped pin which retains and preloads the spring.
Figure 40:
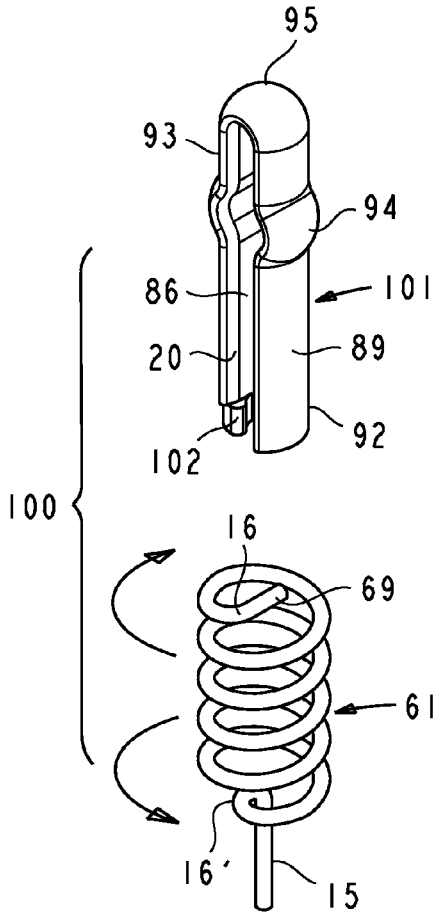
FIG. 40 is an exploded perspective view of the contact of FIG. 39.
Figure 41:
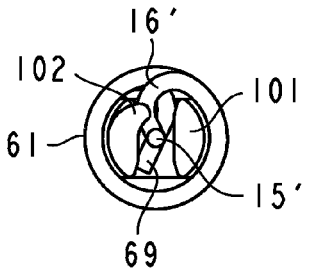
FIG. 41 is a bottom view of the contact of FIG. 39.

Contact 100 in FIGS. 39-41 is a variation of contact 90, comprising pin 101 and spring 61. The pin further comprises a detent 102, which enables attaching the spring to the pin in a preloaded state. The detent protrudes into the coupling slot and forms a narrowing in the slot, which can be traversed by the hooks of the spring, when the spring is twisted. The tines can resiliently deflect when the hooks of the spring traverse the detents. After the second hook of the spring traverses the detent, the hook is allowed to rotate back to make a contact to the respective coupling surface 20 of the pin. FIG. 41 shows second hook 16' of the spring behind detent 102. The detent prevents the spring from disengaging the pin, and enables the spring to be retained on the pin in a preloaded state.

Figure 42:
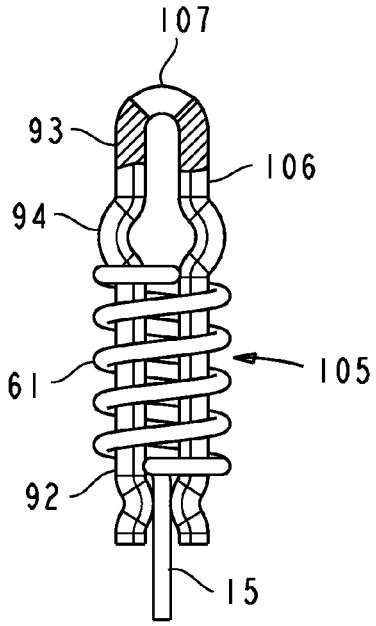
FIG. 42 is a side view of a contact comprising a coil spring contact and a U-shaped pin which retains and preloads the spring.
Figure 43:
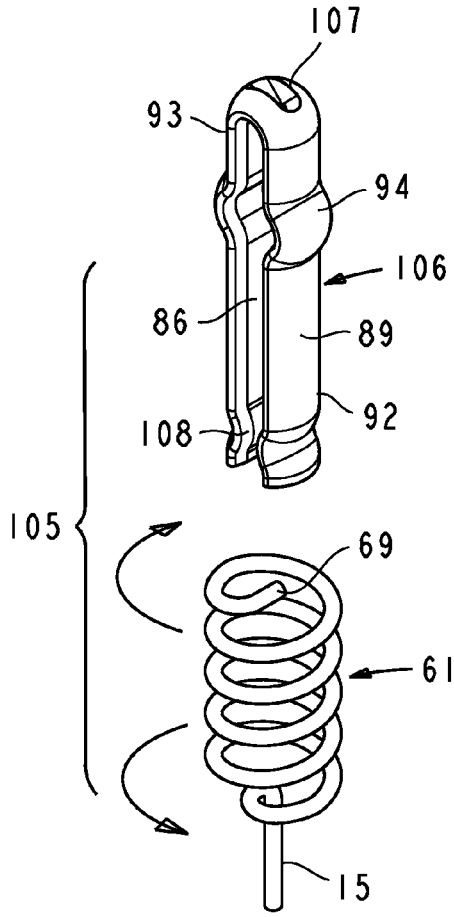
FIG. 43 is an exploded perspective view of the contact of FIG. 42.
Figure 44:
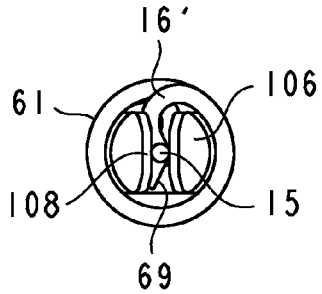
FIG. 44 is a bottom view of the contact of FIG. 42.

Contact 105 in FIGS. 42-44 is another variation of a contact having a stamped U-shaped pin. The contact comprises a pin 106 and spring 61. The pin comprises a contact tip 107 which has a cutout providing sharp contact edges which make the contact suitable for use with solder ball terminals of BGA devices. The ends of tines 92 are formed inwardly to provide detents 108. The detents enable attaching the spring to the pin in a preloaded state. The detents form a passage that can be traversed by the hooks of the spring, when the spring is twisted. The ends of the tines can resiliently spread to facilitate entry of the hooks. After the second end of the spring traverses the detents, the second hook of the spring is allowed to rotate back and to make a contact to the respective coupling surface of the pin. If the passage between the detents is narrower than the diameter of the filar, contact forces are generated between the filar and the detents. The filar of the spring can thus be in conductive sliding contact with the detents even in the absence of a torsional bias of the spring. FIG. 44 is an end view of contact 105. The second hook 16' of the spring is behind detent 108, which prevents the spring from disengaging the pin. The filar is in contact with the inwardly formed surfaces of the detents.

Figure 45:
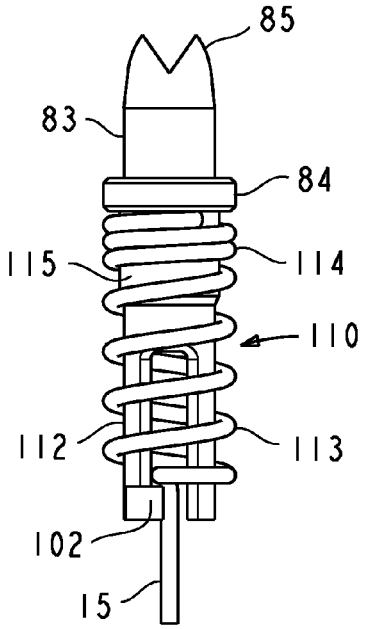
FIG. 45 is a side view of a contact comprising a coil spring attached to the pin by an interference fit between end coils of the first end of the spring and the pin.
Figure 46:
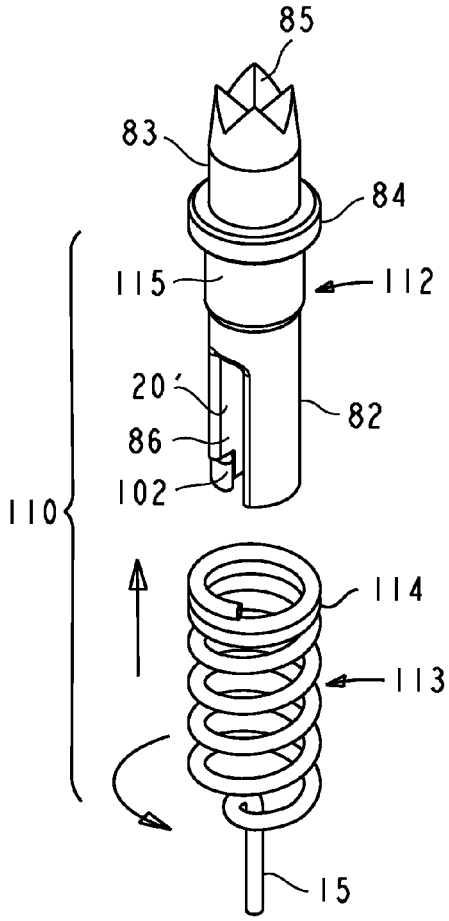
FIG. 46 is an exploded perspective view of the contact of FIG. 45.
Figure 47:
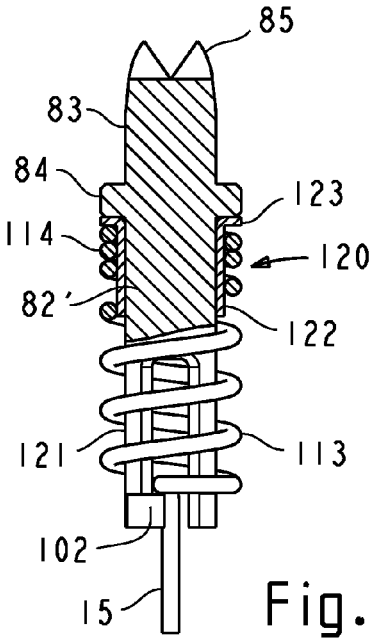
FIG. 47 is a partially cross-sectioned side view of a contact having the first end of the spring electrically insulated from the pin.

FIGS. 45-47—Contact Having Spring Attached to Pin by End Coils Interference

Contacts 60 and 80 described above employ the first hook of the spring to non-rotatably and non-slidably attach the first end of the spring to the pin. In these contacts, the first end of the spring must be essentially affixed to the pin. This can be accomplished in a variety of ways including an interference fit, laser welding, soldering, adhesive bonding, secondary forming operations, and alike. The first end of the spring can be adapted for a particular method of attachment. As an example, this section discloses contact embodiments having a spring attached to the pin by an interference fit between a diametrically enlarged portion of the pin and the end coils on the first end of the spring. Further disclosed is a contact embodiment having the first end of the spring electrically isolated from the pin.

FIG. 45 is a side view, and FIG. 46 is an exploded view, of a contact 110 comprising a pin 112, and a compression coil spring 113. The first end of the spring has closely wound end coils 114. The inner portion of the pin has a diametrically enlarged portion 115, which has an outside diameter that is larger than the inside diameter of the coils. In order to assemble the spring, the spring is rotated until hook 16 is at a predetermined angle to respective coupling surface 20' of the pin. The end coils are then pressed onto the diametrically enlarged portion of the pin up to the collar 84. This creates a resilient interference fit which enables the end coils to be affixed to the pin. Subsequently, the second end of the spring is twisted to align the hook with slot 86, and axially preloaded so that the hook of the spring traverses the slot narrowing formed by detent 102. When the hook is allowed to rotate back behind the detent, the spring is retained on the pin in a preloaded state. Depending on the predetermined angular orientation of the hook relative to the coupling surface of the pin, the spring can have a desired assembly twist, which provides a torsional bias for a conductive engagement of the pin and the spring.

FIG. 47 is a partially cross-sectioned side view of contact 120 comprising pin 121, spring 113, and an insulating sleeve 122. The insulating sleeve is substantially tubular and comprises a collar 123. The sleeve is interposed between the end coils of the spring and the pin, and electrically isolate the first end of the spring from the pin. This forces the current to flow from the pin directly to the second end of the spring while entirely bypassing the first end and the coils of the spring. In the previously discussed embodiments the bulk resistance of the pin is much lower than that of the spring and the current will tend to flow through the pin to the second end of the conductively coupled spring, while substantially bypassing the first end and the coils of the spring. However, insulating the first end of the spring from the pin, as in contact 120, will force the entire current to flow from the pin directly to the second end of the spring, thus making the first end and the coils of the spring electrically insignificant. This will enhance the contact performance at high frequencies.

The sleeve can be fabricated from a thin plastic tubing and pre-installed on the pin or in the end coils of the spring. After all the components are assembled with an interference, the end coils are non-rotatably attached to the pin. Alternatively, an adhesive preform or coating can be used, which can be fused to both the pin and the spring by curing or by application of heat.

Materials and Fabrication

Many material and plating combinations have been useful in electrical contacts and are applicable to the disclosed designs. The commonly used base metals include: tool steel, stainless steel, and beryllium copper for the pin and music wire, stainless steel, and beryllium copper for the spring.

When conductivity is important, the pin can be made from beryllium copper. Beryllium copper stock can be mill-hardened or, alternatively, the pin can be heat treated after fabrication. Pins are further plated, typically about 1.0 μm minimum hard gold over 1-2 μm of electroless nickel. When hardness and durability are very important, the pin can be made from a tool steel, heat treated, and plated with rhodium, palladium-nickel, or other hard and wear resistant plating, preferably with a low coefficient of friction. The pin can be further plated with a thin layer of soft gold (e.g., 0.14 μm thick) or treated with a conductive lubricant to enhance the sliding contact and to mitigate galling, in order to increase the contact's cycle life.

The pin can be stamped or screw machined from a profiled stock 25 shown in FIG. 5, or formed from a profiled stock 98 shown in FIG. 38, as described in more detail above. Alternatively, the pin can be machined from a round stock. The feature geometries can be optimized for the chosen fabrication process. Pins for miniature contacts will have an overall diametrical dimension of about 1.0 mm or less, but they can also be easily scaled up for use in considerably larger contacts.

Only the ends of the spring are a part of the primary current path. The spring's material can therefore be selected based on mechanical merits rather than electrical conductivity. The springs for the miniature contacts, having an outside diameter of about 1.0 mm or less, will have best mechanical performance when made from music wire. Beryllium copper can be used when non-magnetic properties are required. Stainless steel can be used when elevated temperature exposure is a consideration.

The insulative housing can be machined or molded from a polymeric material such as polyetheretherketone, polyamide-imide, polyimide, polyphenylene sulfide, polycarbonate, polyester, and alike, which can be reinforced, e.g., with glass fiber.

The insulative sleeve for contact 120 can be made from polyimide, or other polymeric material, including thermoplastics and elastomers.

Advantages

The disclosed contacts provide a combination of desirable features not realized in the known art. These include:

(1) Low inductance and low resistance; a torsional bias of the spring is used to establish a conductive path through the pin, while substantially bypassing the coils of the spring.

(2) The torsional bias of the spring provides a predictable contact force between the pin and the spring ends; the contact force can be graduated by varying the magnitude of the torsional bias.

(3) The conductive path through the pin makes the spring less electrically significant; the spring material and plating can be selected based on mechanical merits, rather than electrical conductivity.

(4) The external coupling surfaces are well defined and can have desired hardness, surface finish, and plating, to assure a predictable contact force and favorable sliding friction characteristics.

(5) The pin can be economically fabricated from a drawn profiled stock by screw machining or stamping.

(6) Essential pin features can be prefabricated in a drawn profiled stock with a high degree of dimensional accuracy and reproducibility. A drawn profiled stock can provide surface features, such as small edge rounds, that would be impractical to attain by machining alone.

(7) One piece handling; a two-piece contact can be handled as a unit; the pin can be positively attached to the spring using the torsional bias of the spring.

(8) The spring can be retained by the pin in a preloaded state, thus reducing contact force variation, lowering the connector profile, and eliminating assembly loads on the insulator housing.

(9) The compression-generated bias is self-cancelling on unloading due to the spring recoil, which helps the contact tips to recover to the original extension.

(10) Disclosed contacts are particularly useful in sizes of about 1 mm, but can be easily scaled up, e.g., to provide larger contacts for heavy duty use, high current capability, or other special applications.

While the contacts and connectors have been described by means of specific embodiments, numerous modifications and variations known to those skilled in the art or disclosed may be employed without departing from the scope of the invention set forth in the claims. As to every element, it may be replaced by one of multiple equivalent alternatives, only some of which are disclosed in the specification. Thus the scope should be determined, not by the examples or specifics given, but by the appended claims and their legal equivalents.

I claim:

1. An electrical contact for use in a connector for connecting a first electrical device to a second electrical device, the contact comprising:

(a) a conductive compression coil spring having a central axis, a first end, a second end, and a predetermined coiled length in a free state; the first end having a first hook and a first filar; the first hook being inwardly formed toward the central axis, and the first filar being substantially aligned with the central axis and adapted for making a conductive connection to an input/output terminal of the first device; the second end having a second hook and a second filar, the second hook being inwardly formed toward the central axis, and the second filar being substantially aligned with the central axis and adapted for making a conductive connection to an input/output terminal of the second device; and (b) a conductive pin comprising a first end portion, a second end portion, and a middle portion; the pin further comprising a lengthwise channel having coupling surfaces adapted to slidably and non-rotatably engage the hooks of the spring;

wherein the spring and the pin are coaxially disposed and the hooks of the spring are slidably and non-rotatably engaged with the coupling surfaces of the pin, and wherein when the contact is compressed between the first device and the second device, the spring provides an axial bias for a conductive connection of the filars to the respective input/output terminals of the first device and the second device.

2. The contact of claim 1 wherein the hooks of the spring have an initial angle between them when the spring is in a free state, and wherein the spring is twisted a predetermined angle to align the hooks with the respective coupling surfaces of the pin; and wherein the predetermined angle of twist provides a torsional bias for a conductive coupling between the spring and the pin.

3. The contact of claim 2 wherein the first end portion of the pin has a first detent, and the second end portion of the pin has a second detent; the axial distance between the detents being smaller than the predetermined coiled length of the spring in a free state; whereby after the first hook and the second hook are inserted into the coupling channel with the spring twisted and axially preloaded, the first detent retains the first hook of the spring and the second detent retains the second hook of the spring; thus positively retaining the preloaded spring on the pin.

4. The contact of claim 3, wherein the predetermined angle of twist is in the spring winding direction.

5. The contact of claim 3, wherein the predetermined angle of twist is in the direction opposite to the spring winding direction.

6. The contact of claim 1 wherein the first end portion of the pin is formed to substantially close the adjoining end of the coupling channel, and wherein the second end portion of the pin is initially open to provide an assembly passage for the hooks of the spring; the axial distance between the end portions of the pin being smaller than the predetermined coiled length of the spring in a free state; whereby after the hooks are inserted into the coupling channel with the spring axially preloaded, the second end portion of the pin is crimped to substantially close the passage and thus to positively retain the preloaded spring on the pin.

7. The contact of claim 1 wherein the pin further comprises at least one outside surface, and further comprises edge rounds, wherein the at least one outside surface locates and guides the coil spring.

8. The contact of claim 7, wherein the coupling surfaces, the edge rounds, and the at least one outside surface are substantially pre-formed in a drawn profiled stock from which the pin is fabricated by one or more processes selected from the group consisting of stamping, screw machining, machining, abrasive machining, and electromachining.

9. The contact of claim 1, wherein the pin further comprises a cross-sectional profile selected from the group consisting of: a substantially U-shaped profile, a substantially V-shaped profile, and a substantially C-shaped profile.

10. An electrical contact for use in a connector for connecting a first electrical device to a second electrical device, the contact comprising:

(a) a conductive compression coil spring having a central axis, a first end, a second end, and a predetermined coiled length in a free state; the first end and the second end of the spring being adapted to non-rotatably engage a conductive pin; the second end of the spring having a filar, the filar being substantially aligned with the central axis and adapted for making a conductive connection to an input/output terminal of the second device; and (b) a conductive pin comprising an inner portion, an outer portion, and an inner end; the outer portion having a contact tip adapted for making a separable conductive connection to an input/output terminal of the first device; the inner portion being adapted to non-rotatably engage the first end of the spring, and to non-rotatably and slidably engage the second end of the spring;

wherein when the contact is compressed between the first device and the second device, the spring provides an axial bias for a conductive connection of the pin's contact tip to the first terminal, and for a conductive connection of the spring's filar to the corresponding input/output terminal of the second device.

11. The contact of claim 10 wherein the first end of the spring comprises a first hook and the second end of the spring further comprises a second hook, each hook formed inwardly toward the central axis; the hooks having an initial angle between them when the spring is in a free state; and wherein the inner portion of the pin has coupling surfaces; and wherein the spring is twisted a predetermined angle to align the hooks with the respective coupling surfaces of the pin; whereby the predetermined angle of twist provides a torsional bias for a conductive coupling between the hooks of the spring and the pin.

12. The contact of claim 11, wherein the predetermined angle of twist is in the spring winding direction.

13. The contact of claim 11, wherein the predetermined angle of twist is in the direction opposite to the spring winding direction.

14. The contact of claim 11 wherein the inner portion of the pin has a lengthwise slot, wherein the sides of the slot provide the coupling surfaces, and wherein the inner body of the pin further has at least one detent adapted to positively attach the spring to the pin.

15. The contact of claim 11 wherein the inner portion of the pin further has a trap hole adapted to captivate the first hook of the spring and thus positively attach the spring to the pin.

16. The contact of claim 10, wherein the pin further comprises a collar which supports the first end of the spring and provides a retention means for retaining the contact in an insulator housing cavity.

17. The contact of claim 10 wherein the inner end of the pin has at least one detent adapted to retain the spring on the pin in a preloaded state.

18. The contact of claim 10 wherein the pin comprises a rounded contact tip and two tines forming a substantially U-shaped configuration; each tine having at least one coupling surface to non-rotatably engage a respective end of the spring; each tine further having an outside surface adapted to locate and guide the spring; and wherein the pin is formed from a drawn profiled stock, the profiled stock having the at least one coupling surface and the outside surface prefabricated by the drawing process.

19. The contact of claim 18 wherein the pin further has substantially arcuate shoulders formed outwardly away from the central axis, and wherein the shoulders support the first end of the spring and provide retention means for retaining the contact in an insulator housing cavity.

20. The contact of claim 10 wherein the inner portion of the pin has a diametrically enlarged portion and the first end of the spring comprises end coils, the end coils being non-rotatably engaged with the inner portion of the pin by an interference fit between the diametrically enlarged portion of the pin and the end coils of the spring.

21. The contact of claim 10 further comprising an insulating sleeve, wherein the first end of the spring comprises end coils, the end coils being non-rotatably engaged with the inner portion of the pin and the sleeve, and wherein the sleeve electrically isolates the end coils of the spring from the pin; whereby the electrical isolation of the first end of the spring from the pin enables the current to flow from the pin directly to the second end of the spring, while bypassing the first end of the spring and the coiled length of the spring.

22. An electrical connector for connecting a first electrical device having a first array of input/output terminals to a second electrical device having a second array of input/output terminals; the second array being opposite and complementary to the first array; the connector comprising:

(a) a dielectric housing having a plurality of cavities, the cavities arranged in an array complementary to the arrays of the first and second arrays of the input/output terminals; each cavity adapted to accommodate a contact; and (b) a plurality of contacts, each contact received in a respective cavity of the dielectric housing; each contact comprising:

a conductive compression coil spring having a central axis, a first end, and a second end; the first end having a first hook and a first filar; the first hook being inwardly formed toward the central axis, and the first filar being substantially aligned with the central axis and adapted for making a conductive connection to an input/output terminal of the first device; the second end having a second hook and a second filar, the second hook being inwardly formed toward the central axis, and the second filar being substantially aligned with the central axis and adapted for making a conductive connection to an input/output terminal of the second device; and a conductive pin comprising a first end portion, a second end portion, and a middle portion; the pin further comprising a lengthwise channel having coupling surfaces adapted to slidably and non-rotatably engage the hooks of the spring;

wherein the spring provides a torsional bias for a conductive coupling between the hooks of the spring and the respective coupling surfaces of the pin, and wherein when the contact is compressed between the first device and the second device, the spring provides an axial bias for a resilient conductive connection of the filars to the respective input/output terminals of the first and the second device.

23. The connector of claim 22 wherein each contact further has a retention means adapted to retain the contact in the insulator housing cavity, and each cavity comprises an inner opening, retaining surfaces, and outer openings, and wherein: the inner opening accommodates the middle portion of the pin and the spring; the outer openings locate the respective outer portions of the pin; and the retaining surfaces cooperate with the corresponding retention means in the contact to retain the contact in the insulator housing cavity.

24. An electrical connector for connecting a first electrical device having a first array of input/output terminals to a second electrical device having a second array of input/output terminals; the second array being opposite and complementary to the first array; the connector comprising:

(a) a dielectric housing having a plurality of cavities, the cavities arranged in an array complementary to the arrays of the first and second arrays of the input/output terminals; each cavity adapted to accommodate a contact; and (b) a plurality of contacts, each contact received in a respective cavity of the dielectric housing; each contact comprising:

a conductive compression coil spring having a central axis, a first end, and a second end; the first end and the second end of the spring being adapted to non-rotatably engage a conductive pin; the second end having a hook and a filar, the hook being inwardly formed toward the central axis; the filar being substantially aligned with the central axis and adapted for making a conductive connection to an input/output terminal of the second device; and a conductive pin comprising an inner portion, an outer portion, and an inner end; the outer portion having a contact tip adapted for making a separable conductive connection to an input/output terminal of the first device; the inner portion being adapted to non-rotatably engage the first end of the spring, and to non-rotatably and slidably engage the hook on the second end of the spring;

wherein the spring provides a torsional bias for a conductive coupling between the hook of the spring and the pin, and wherein when the contact is compressed between the first device and the second device, the spring provides an axial bias for a conductive connection of the pin's contact tip to a respective input/output terminal the first device, and for a conductive connection of the spring's filar to a corresponding input/output terminal of the second device.

25. The connector of claim 24 wherein each contact further has a retention means adapted to retain the contact in the insulator housing cavity, and each cavity comprises an inner opening, retaining surfaces, and outer openings, wherein: the inner opening accommodates the inner portion of the pin and the spring; the outer openings locate and guide the respective outer portion and the inner end of the pin; and the retaining surfaces cooperate with the corresponding retention means in the contact to retain the contact in the insulator housing cavity.

* * * * *